United States Patent [19]

Lee

[11] Patent Number: 4,627,480

[45] Date of Patent: Dec. 9, 1986

[54] ANGLED TURBULENCE PROMOTER

[75] Inventor: Ching-Pang Lee, Cincinnati, Ohio

[73] Assignee: General Electric Company, Cincinnati, Ohio

[21] Appl. No.: 696,623

[22] Filed: Jan. 29, 1985

Related U.S. Application Data

[60] Division of Ser. No. 549,219, Nov. 7, 1983, Pat. No. 4,514,144, which is a continuation-in-part of Ser. No. 506,156, Jun. 20, 1983, abandoned.

[51] Int. Cl.[4] ..... B22C 9/10

[52] U.S. Cl. ..... 164/369; 164/122.1

[58] Field of Search ..... 164/369, 122.1, 122.2

[56] References Cited

U.S. PATENT DOCUMENTS 4,257,737 3/1981 Andree et al. ..... 416/97 R

*Primary Examiner*—Kuang Y. Lin

*Attorney, Agent, or Firm*—Douglas S. Foote; Derek P. Lawrence

[57] ABSTRACT

A ceramic core for use in the casting of a hollow turbine blade comprising at least one passage core portion with first and second opposite surfaces. A plurality of first grooves are disposed on the first surface at a first angle with respect to the centerline of the first surface. A plurality of second grooves are disposed on the second surface at a second angle with respect to the centerline of the second surface. The first angle is less than 90° and the second angle is greater than 90°.

4 Claims, 14 Drawing Figures

ANGLED TURBULENCE PROMOTER

This is a division of application Ser. No. 549,219, filed Nov. 7, 1983, now U.S. Pat. No. 4,514,144 which is a continuation-in-part of application Ser. No. 506,156, filed June 20, 1983 abandoned.

The present invention relates in general to turbine blades and, more particularly, to the design of internal cooling passages within such blades.

BACKGROUND OF THE INVENTION

In gas turbine engines, hot gases from a combustor are used to drive a turbine. The gases are directed across turbine blades which are radially connected to a rotor. Such gases are relatively hot. The capacity of the engine is limited to a large extent by the ability of the turbine blade material to withstand the resulting thermal stress. In order to decrease blade temperature, thereby improving thermal capability, it is known to supply cooling air to hollow cavities within the blades. Typically one or more passages are formed within a blade with air supplied through an opening at the root of the blade and allowed to exit through cooling holes strategically located on the blade surface. Such an arrangement is effective to provide convective cooling inside the blade and film-type cooling on the surface of the blade. Many different cavity geometries have been employed to improve heat transfer to the cooling air inside the blade. For example, U.S. Pat. Nos. 3,628,885 and 4,353,679 show internal cooling arrangements.

One technique for improving heat transfer is to locate a number of protruding ribs along the interior cavity walls of the blade. By creating turbulence in the vicinity of the rib, heat transfer is thereby increased. In the past, such turbulence promoting ribs have been disposed at right angles to the cooling airflow. Such rib orientation is shown, for example, in U.S. Pat. No. 4,257,737. One problem with the use of turbulence promoting ribs perpendicular to the airflow is that dust in the cooling air tends to buildup behind the ribs. This buildup reduces heat transfer.

Turbulence promoting ribs also affect pressure and flow rate within the blade. It is imperative that the exit pressure of cooling air at the cooling holes exceed the pressure of the hot gases flowing over the blades. This difference in pressure is known as the backflow margin. If a positive backflow margin is not maintained, cooling air will not flow out of the blade, and the hot gases may enter the blade through the cooling holes thereby reducing blade life. Over and above the benefit of maintaining a positive backflow margin, a high exit pressure at the exit holes provides the benefit of imparting a relatively high velocity to the cooling air as it exits from these holes. Since most of these holes have a downstream vector component, a smaller energy loss from the mixing of the two airstreams or greater energy gain, depending on the magnitude of the air velocity, results thereby improving engine efficiency.

To ensure that exit pressure is sufficiently high, two criteria must be satisfied. First, pressure delivered to the cooling air inlet to the blade must be high. Second, the decrease of pressure between the inlet and exit must be low. This second criterion, known as pressure drop or delta p, is proportional to the friction factor inside the blade and the square of the flow rate. Delta p shows improvement as the friction factor decreases. The friction factor is affected in part by the geometry at the cooling passage walls. For instance, turbulence promoting ribs increase the friction factor by increasing shear stress which creates vortices behind the ribs.

Turbulence promoting ribs therefore simultaneously improve heat transfer while worsening pressure drop.

OBJECTS OF THE INVENTION

It is an object of the present invention to provide new and improved means of cooling a turbine blade.

Another object of the present invention to provide a new and improved turbulence promoting rib within a turbine blade which reduces dust accumulation therein.

Still another object of the present invention to provide a new and improved turbulence promoting rib within a turbine blade which lowers the cooling air pressure drop therein.

A further object of the present invention to provide a new and improved turbulence promoting rib within a turbine blade which increases heat transfer.

It is a further object of the present invention to provide a new and improved turbulence promoting pin array within a turbine blade which increases heat transfer.

It is yet a further object of the present invention to provide a new and improved casting core for a turbine blade.

It is another object of the present invention to provide a new and improved casting core for a turbine blade with increased resistance to bending stress.

SUMMARY OF THE INVENTION

In one form of the present invention, a gas turbine blade with an internal cooling passage having two, substantially opposite walls has a plurality of ribs integrally connected thereto. The ribs on one wall are disposed at a first angle with respect to the center line of that wall and the ribs on the opposite wall are disposed at a second angle with respect to the center line of its wall. Each such rib is separated into at least two rib members by a turbulence promoting gap.

DETAILED DESCRIPTION OF THE INVENTION

As used and described herein the term "turbine blade" is intended to include turbine stator vanes, rotating turbine blades as well as other cooled airfoil structures.

Figure 1:
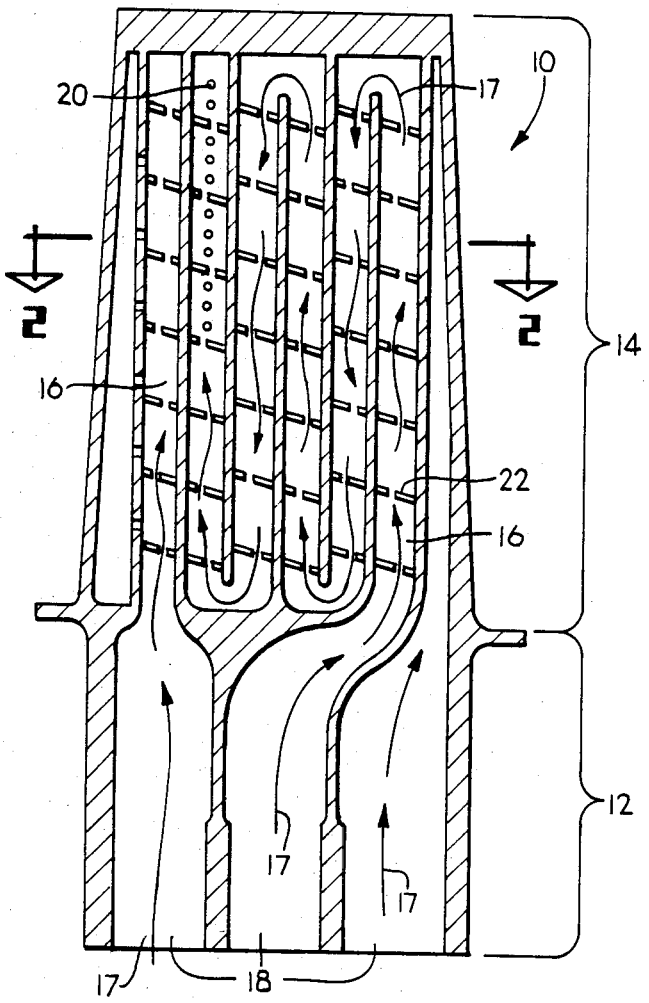
FIG. 1 is a cross-sectional view of a turbine blade in accordance with one form of the present invention.

FIG. 1 shows a cross-sectional view of turbine blade 10 with shank 12 and airfoil 14. A plurality of internal passages 16 direct the flow of cooling air 17 inside blade 10. Each such passage 16 is connected at one end to a cooling air inlet 18 within shank 12. At various locations along and towards the other end of passage 16 a plurality of cooling holes 20 are positioned. These holes provide a flowpath for cooling air inside passages 16 to the gas stream outside the blade. Also shown inside passages 16 are a plurality of angled turbulence promoting ribs 22. It should be noted that the orientation of ribs 22 in adjacent passages 16 is generally the same. Thus, any swirling of cooling air 17 is maintained in the same direction as it flows one passage to the next.

Figure 3:
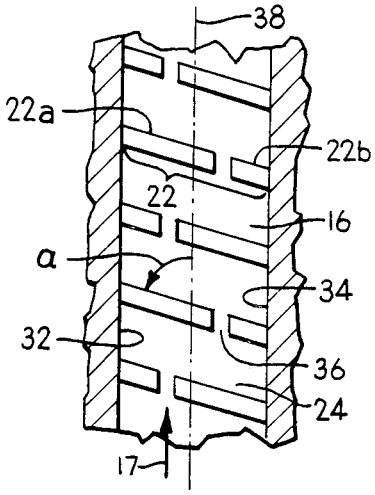
FIG. 3 is a partial sectional view taken through line 3—3 of FIG. 2.
Figure 4:
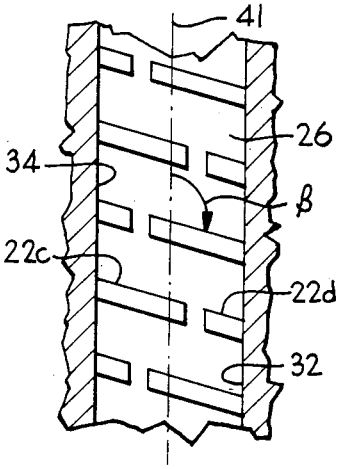
FIG. 4 is a partial sectional view taken through line 4—4 of FIG. 2.
Figure 2:
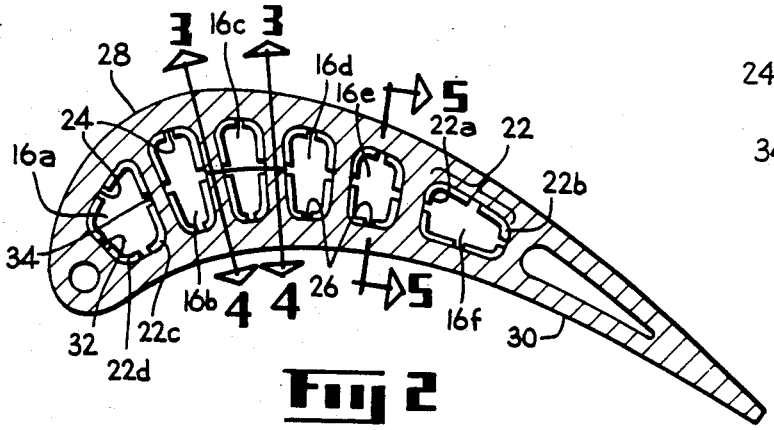
FIG. 2 is a view taken along the line 2—2 in FIG. 1.

Ribs 22 are shown in more detail in FIGS. 2, 3, and 4. FIG. 2 is a sectional view taken along line 2—2 in FIG. 1. Ribs 22 are disposed in passages 16*a*, 16*b*, 16*c*, 16*d*, 16*e*, and 16*f*. Each of passages 16*a*–*f* has a unique cross section ranging from substantially rectangular in passage 16*b* to nearly trapezoidal in passage 16*d*. In general, however, passages 16 are substantially quadralateral in shape with two pairs of opposite walls. A first pair of opposite walls 24 and 26 conform substantially in direction to suction side blade surface 28 and pressure side blade surface 30 respectively. A second pair of opposite walls 32 and 34 join walls 24 and 26 so as to form each passage 16.

FIG. 3 is a partial sectional perspective view of wall 24 taken along line 3—3 in FIG. 2. FIG. 3 shows in closer detail the shape of ribs 22 and their orientation with respect to the center line 38 of passage 16. Each rib 22, extending between walls 32 and 34 and integral with wall 24, has a substantially rectangular cross section. Each rib 22 is oriented at a first angle alpha measured counterclockwise from center line 38 to rib 22. It is preferred that the value of alpha is between 40° and 90° with a value of 60° in one embodiment. Each rib 22 is divided into rib members 22*a* and 22*b* by a gap 36. Adjacent ribs on the same channel wall generally are oriented at the same angle, however, gaps 36 may be staggered with respect to center line 38.

FIG. 4 is a partial sectional perspective view of wall 26 taken along the line 4—4 in FIG. 2. FIG. 4 shows the orientation of ribs 22 with respect to the center line 41 of wall 26. Each rib 22 is oriented at a second angle beta measured clockwise from center line 41 to rib 22. It is preferred that the value of beta is between 90° and 140° with a value at 120° in one embodiment.

Figure 5:
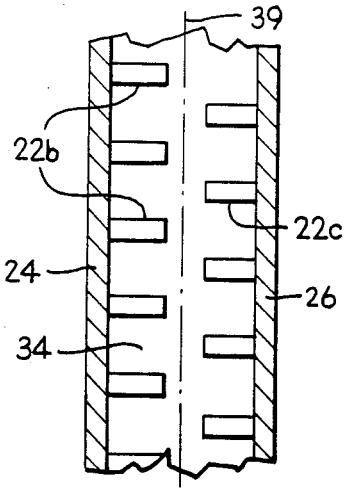
FIG. 5 is a partial sectional view taken through line 5—5 of FIG. 2.

FIG. 5 shows a partial sectional perspective side view of wall 34. Ribs 22 extend respectively from walls 24 and 26. More particularly, rib member 22*b* extends from wall 24 onto wall 34, and rib member 22*c* extends from wall 26 onto wall 34. Each rib member 22*b* and 22*c* is substantially perpendicular to the direction of center line 39. In the embodiment shown, neither rib member 22*b* nor member 22*c* extends beyond center line 39 of wall 34. The above-described orientation of ribs 22 on wall 34 applies equally with respect to ribs 22 on wall 32. More specifically, in a preferred embodiment rib members 22*a* and 22*d* are disposed on wall 32, perpendicular to the center line of wall 32, and extending respectively from walls 24 and 26 no further than the center line of wall 32.

Figure 6:
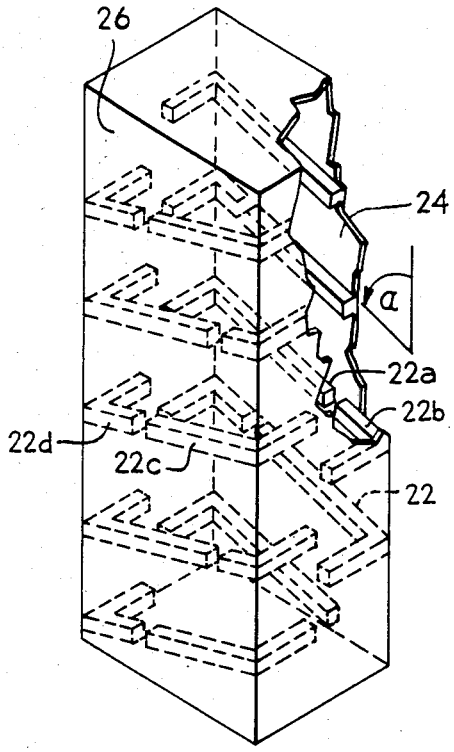
FIG. 6 is a fragmentary, perspective, diagrammatic presentation of an internal cooling passage of a turbine blade with turbulence promoting ribs in accordance with one form of the present invention.

FIG. 6 is a diagrammatic presentation of an internal cooling passage showing the rib configuration therein. Ribs 22 on wall 24 are not parallel to ribs 22 on wall 26. As described above, each rib 22 on wall 24 is disposed at a first angle alpha with respect to a plane through center line 38 and perpendicular to side 24, angle alpha being measured counterclockwise from such plane to rib 22 when viewed from pressure side 30. Each rib 22 on wall 26 is disposed at second angle beta with respect to a plane through the center line 41 of wall 26 and perpendicular to side 26, angle beta being measured clockwise from such plane to rib 22 when viewed from suction side 28. Alternatively, angles alpha and beta may be measured clockwise and counterclockwise respectively from the aforesaid planes. Ribs 22 on walls 32 and 34 are substantially parallel.

The invention is not limited to the above-described embodiment. Numerous variations are possible. For example, gaps 36 of adjacent ribs 22 need not be staggered with reference to the center line of their passage wall. Moreover, more than one gap on each rib can be included. Also a gap can be positioned at one or both ends of rib 22.

Figure 11:
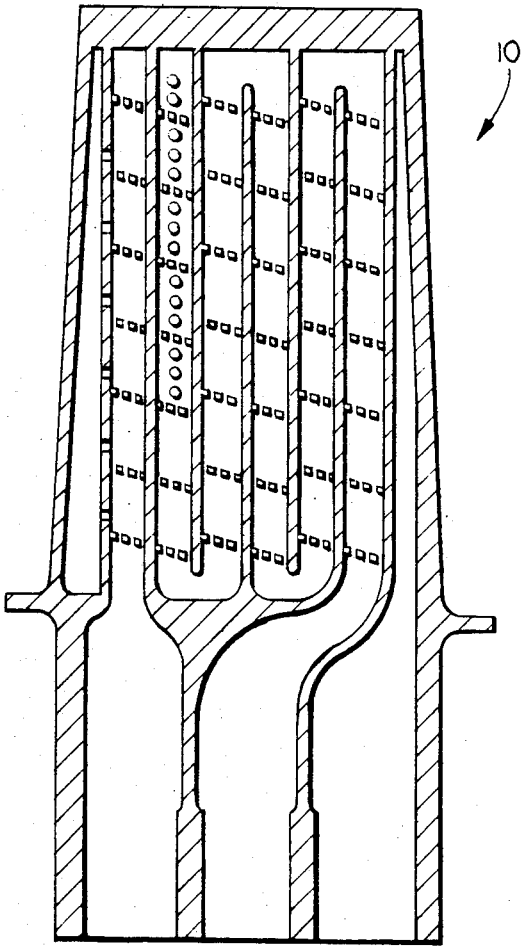
FIG. 11 is a cross-sectional view of a turbine blade in accordance with an alternative form of the present invention.

FIG. 11 shows a cross-sectional view of turbine blade 10 according to an alternative form of the present invention. As shown therein, and in greater detail in FIG. 12, ribs 22 are each divided into a plurality of rib members 23*a*, 23*b*, etc. by a plurality of gaps, 36*a*, 36*b*, etc. The maximum number of gaps 36*a*, 36*b*, etc. and the minimum width of rib members 23*a*, 23*b*, etc. are determined by casting limitations.

Figure 12:
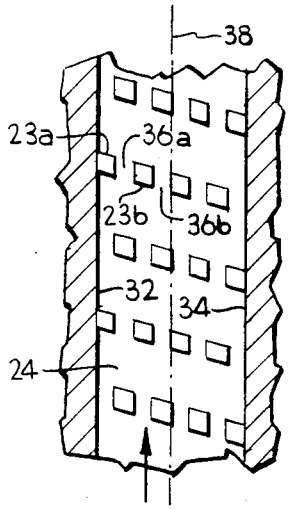
FIG. 12 is a view of one passage wall of the blade in FIG. 11.
Figure 13:
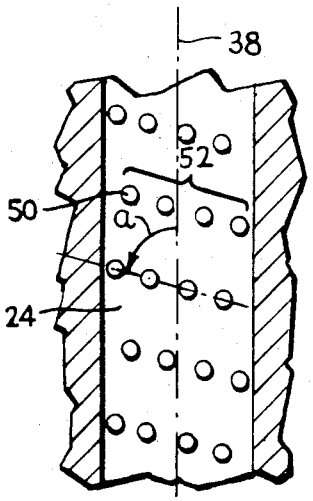
FIG. 13 is a view of a passage wall of a blade according to another form of the present invention.

As an alternative to the guadralaterally shaped rib members 23*a*, 23*b*, etc. shown in FIGS. 11 and 12, various other geometric shapes are possible. For example, FIG. 13 shows circularly shaped pins 50 replacing rib members 23*a*, 23*b*, etc. Each row of non-abutting aligned pins 50 forms a pin array 52. As with ribs 22, each array 52 is integral with wall 24 or 26 and each is positioned at an angle alpha or beta, respectively, with respect to the center line 38 or 41 of wall 24 or 26.

Both the orientation of ribs 22 on walls 32 and 34 and the length of rib members 22*a*, 22*b*, 22*c* and 22*d* on these walls are affected by casting limitations. For example, the molding of a ceramic casting core for a typical turbine blade requires separation of a core mold. Since the core mold portions generally are separated essentially along a parting line between suction side 28 and pressure side 30, any depressions or rib molds in the planes perpendicular to walls 24 and 26, i.e., walls 32 and 34, must be parallel to the direction of separation. Furthermore, the fact that the core mold consists of two mating parts makes precision casting of a single rib on walls 32 and 34 difficult. For this reason, rib members 22*b* and 22*c* extend just short of center line 39 which is also the parting line of the core mold.

Figure 7:
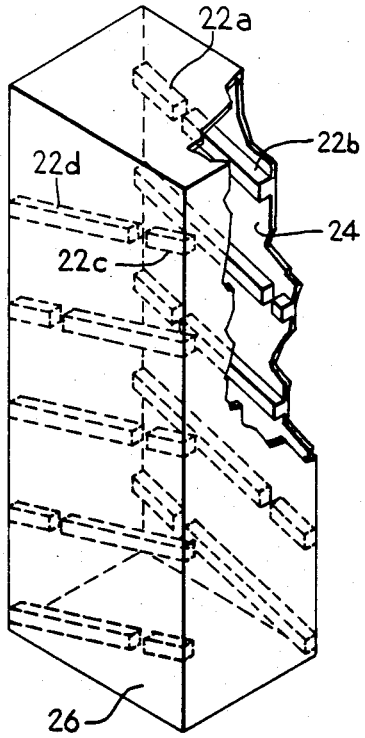
FIG. 7 is a fragmentary, perspective, diagrammatic presentation of an internal cooling passage of a turbine blade with turbulence promoting ribs in accordance with another form of the present invention.

An alternative arrangement of ribs is shown in FIG. 7 in a diagrammatic representation of passage 16. Ribs 22 are confined to walls 24 and 26 and do not extend to walls 34 and 32. The extent to which ribs 22 extend onto walls 32 and 34 varies from no extension, as shown in FIG. 7, to full extension across these walls. It should be understood that cooling air passages are not necessarily rectangular in cross section. For example, various cross sections ranging from irregular quadralaterals and triangles to less well defined shapes are possible and still within the scope of this invention.

Figure 8:
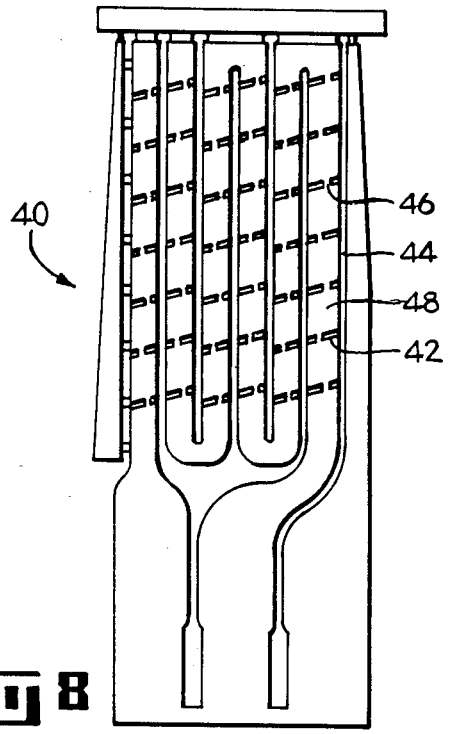
FIG. 8 is a side view of a casting core for the turbine blade shown in FIG. 1.

FIG. 8 shows a side view of a typical molded casting core 40 such as might be used in the manufacture of turbine blade 10 as shown in FIG. 1. The composition of core 40 may be ceramic or any other material known in the art. Angled ribs 22 appear as angled grooves 42 on the surface 48 of passage core portion 44. Gap 36 appears as a wall 46 interrupting groove 42. Each rib 22 on surface 48 is disposed at a first angle with respect to the center line of core portion 44. Ribs 22, not shown, on the surface opposite surface 48 are disposed at a second angle with respect to the center line of core portion 44. By such angling and bifurcation of grooves 42, core 40 is strengthened by increased resistance to bending stress.

Figure 14:
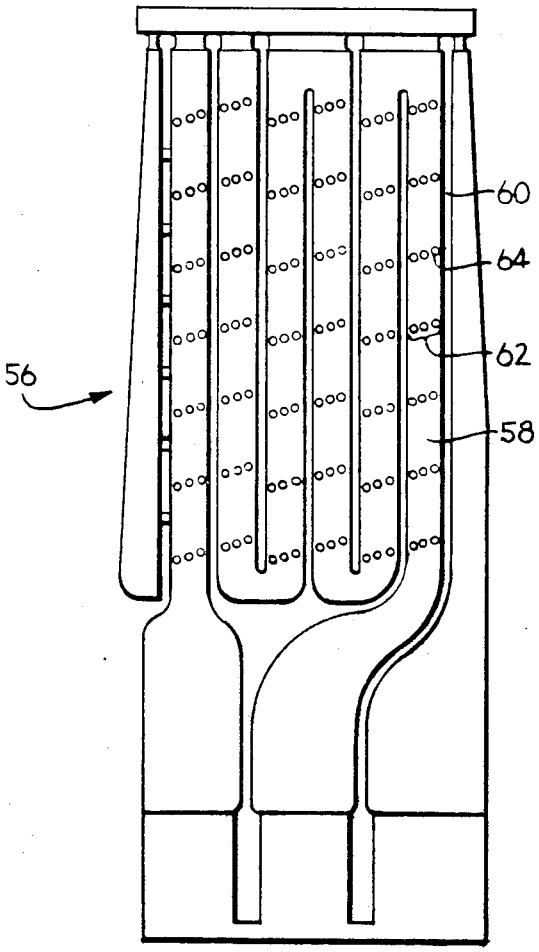
FIG. 14 is a side view of a casting core for a turbine blade with passage wall as shown in FIG. 13.

FIG. 14 shows a side view of a molded casting core 56 capable of being used in the manufacture of a turbine blade with pin arrays as shown in FIG. 13. Each pin 50 appears as a hole 64 on the surface 58 of passage core portion 60. Each pin array appears as a hole array 62 and is disposed at a first angle with respect to the center line of core position 60. A second set of hole arrays, not shown, is disposed on the opposite surface of core portion 60. Each of the second hole arrays is positioned at a second angle with respect to the center line of that opposite surface.

In operation, cooling air 17 enters passages 16 at shank 12 of the turbine blade 10 shown in FIG. 1. As it passes through cooling passages 16 it impinges on angled turbulence promoting ribs 22. Any dust in cooling air 17 will be directed along the angled rib and will tend to pass through gap 36 in each rib 22 thereby preventing its buildup. After passing through passage 16, air 17 exits through cooling holes 20 and enters the gas stream.

In order to incorporate new blades of the present invention on existing engines without otherwise modifying the engine, the flow rate through each new blade must be the same as in current blades. Angled ribs 22 tend to increase flow rate so the diameter and/or number of cooling holes 20 are reduced to keep flow rate constant.

Figure 9:
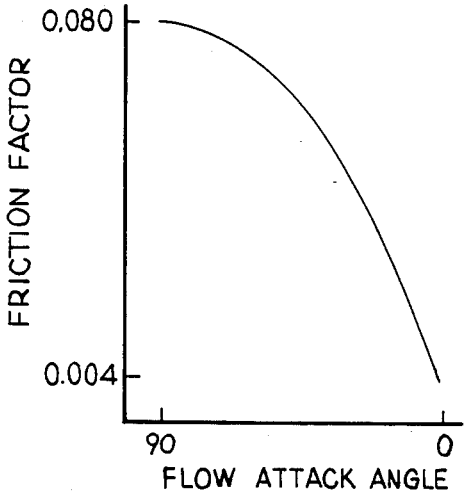
FIG. 9 is a graph of airflow friction factor between two parallel ribbed plates as a function of the flow attack angle to the ribs.

Of critical importance in blade design is maintaining as low a pressure drop, delta p, and as high a heat transfer rate as possible. The improvement, i.e. reduction, of delta p might be expected with angled ribs. Since delta p is proportional to the friction factor, decreasing rib angle from 90° reduces flow resistance or friction thereby reducing delta p. Such improvement for angled ribs on parallel plates was noted in *An Investigation of Heat Transfer and Friction for Rib-Roughened Surfaces,* International Journal of Heat Mass Transfer, Vol. 21, pp. 1143–1156. The results of the study are reproduced as FIG. 9.

Figure 10:
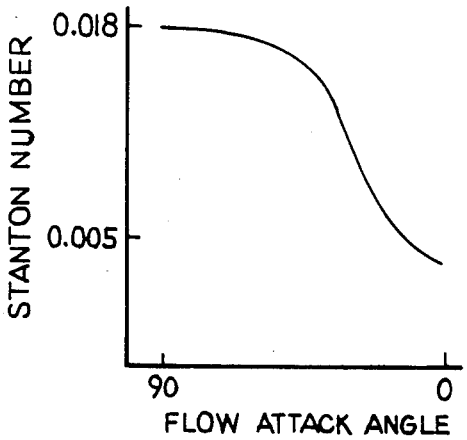
FIG. 10 is a graph of Stanton Number as a function of flow attack angle for airflow between two parallel ribbed plates.

A decrease in the rate of heat transfer might also be predicted for decreasing rib angle from 90°. FIG. 10 shows the empirical results from the above-referenced study for Stanton Number vs. rib angle. It should be noted that Stanton Number is proportional to the rate of heat transfer. As ribs are angled away from 90°, the rate of heat transfer decreases. Such degradation of effective cooling is unacceptable in blade design.

However, by way of contrast, in tests conducted on models of the present invention, improvement in both pressure drop and heat transfer rate was measured. The tests compared a model with ribs angled at 60° to the flowpath and having no gaps to one with similar ribs angled at 90°. In addition, a model with ribs angled at 60°, each rib having a gap, was compared to the 90°, no gap model. The test results were surprisingly and unexpected. A summary of these results is presented in the following Table.

TABLE

| | (delta P) 60/(delta P) 90 | h60/h90 |
|---|---|---|
| No Slot | 0.89–0.99 | 1.05–1.18 |
| With Slot | 0.90–0.96 | 1.12–1.22 |

As is evident from the Table, 60° angled ribs with slots improve pressure drop by 4 to 10% and improve heat transfer rate by 12 to 22%. In addition, it is predicted that dust accumulation behind the ribs will be reduced by the gap in each rib. It should be noted that the range in values shown in the Table represent the results of tests run at different flow rates.

Although at present no data exists for the pin array configuration shown in FIG. 11, improved heat transfer is expected. Moreover, virtually no dust accumulation appears likely.

It will be clear to those skilled in the art that the present invention is not limited to the specific embodiments described and illustrated herein. Nor is the invention limited to the manufacture and production of turbine blades and their molded cores, but it applies equally to turbine stator vanes and generally to turbomachinery with internal cooling passages as well as to cores for manufacturing such articles.

It will be understood that the dimensions and proportional and structural relationships shown in the drawings are illustrated by way of example only and these illustrations are not to be taken as the actual dimensions, proportional or structural relationships used in the turbine blade of the present invention.

Numerous modifications, variations, and full and partial equivalents can be undertaken without departing from the invention as limited only by the spirit and scope of the appended claims.

What is desired to be secured by Letters Patent of the United States is the following:

What is claimed is:

1. A ceramic core for use in the casting of a hollow turbine blade comprising at least one passage core portion with first and second opposite surfaces, wherein:

a plurality of first grooves are disposed on said first surface at a first angle with respect to the center line of said first surface; and a plurality of second grooves are disposed on said second surface at a second angle with respect to the center line of said second surface; said first angle being less than 90° and said second angle being greater than 90°.

2. A core, as recited in claim 1, wherein each of said grooves is interrupted by a wall integral with said surface.

3. A core, as recited in claim 2, wherein said first angle is 60° and said second angle is 120°.

4. A ceramic core for use in the casting of a hollow turbine blade comprising at least one passage core portion with first and second opposite surfaces with a plurality of first and second hole arrays disposed therein, wherein:

each of said first and second hole arrays comprises a plurality of non-abutting aligned holes;

each of said first hole arrays is positioned at a first angle with respect to the center line of said first surface; and each of said second hole arrays is positioned at a second angle with respect to the center line of said second surface.

* * * * *